US010537171B2

(12) United States Patent
Melaragno

(10) Patent No.: US 10,537,171 B2
(45) Date of Patent: Jan. 21, 2020

(54) SHELF ATTACHMENT FOR LOUNGE CHAIR

(71) Applicant: Melanie M. Melaragno, Wickliffe, OH (US)

(72) Inventor: Melanie M. Melaragno, Wickliffe, OH (US)

(73) Assignee: SHORE SHELF LLC, Wickliffe, OH (US)

( * ) Notice: Subject to any disclaimer, the term of this patent is extended or adjusted under 35 U.S.C. 154(b) by 0 days.

(21) Appl. No.: 15/971,716

(22) Filed: May 4, 2018

(65) Prior Publication Data

US 2018/0249838 A1 Sep. 6, 2018

Related U.S. Application Data

(63) Continuation-in-part of application No. 29/624,592, filed on Nov. 2, 2017, now Pat. No. Des. 840,708, and a continuation-in-part of application No. 29/621,902, filed on Oct. 12, 2017, and a continuation-in-part of application No. 15/596,744, filed on May 16, 2017, now Pat. No. 10,201,232.

(60) Provisional application No. 62/337,565, filed on May 17, 2016.

(51) Int. Cl.

| | |
|---|---|
| ***A47B 5/02*** | (2006.01) |
| ***A47B 5/04*** | (2006.01) |
| ***A47B 13/16*** | (2006.01) |

(52) U.S. Cl.

CPC ..... *A47B 5/02* (2013.01); *A47B 5/04* (2013.01); *A47B 13/16* (2013.01)

(58) Field of Classification Search

CPC .. A47C 7/70; A47C 1/143; A47C 1/14; A47B 5/02; A47B 5/04; A47B 13/16; F16B 2/005; F16B 2/10

See application file for complete search history.

(56) References Cited

U.S. PATENT DOCUMENTS

| | | | |
|---|---|---|---|
| 1,891,834 | A | 12/1932 | Pendleton |
| 4,122,780 | A | 10/1978 | Brickman |
| 4,779,884 | A | 10/1988 | Minati |
| 4,936,470 | A | 6/1990 | Prindle |
| 5,333,929 | A | 8/1994 | Slagerman |
| 5,460,276 | A | 10/1995 | McKeon et al. |
| 5,887,940 | A | 3/1999 | Anderson et al. |
| 5,893,331 | A | 4/1999 | Diletto |
| 9,179,769 | B1 | 11/2015 | Port |
| 9,554,643 | B2 | 1/2017 | Nelson et al. |
| 9,629,457 | B2 | 4/2017 | Cohen et al. |
| 9,814,305 | B2 | 11/2017 | Brus et al. |
| 2002/0109058 | A1 | 8/2002 | Gish |
| 2004/0139892 | A1 | 7/2004 | Giegerich |
| 2004/0226486 | A1 | 11/2004 | Simpson |
| 2007/0056482 | A1 | 3/2007 | Robinson et al. |
| 2007/0101908 | A1 | 5/2007 | Makita |

(Continued)

*Primary Examiner* — Hahn V Tran

(74) *Attorney, Agent, or Firm* — Jacob M. Ward; Ward Law Office LLC

(57) ABSTRACT

A shelf attachment for use with a beach or lounge chair is formed of one-piece or has a first shelf half and a second shelf half hingedly and foldably connected to the first shelf half. An elongated member extends through interlocking projections extending from the first shelf half and from the second shelf half to hingedly connect the first and second shelf halves. A first clamp assembly is secured to the first shelf half and a second clamp assembly is secured to the second shelf half to mount the shelf to the rail of a chair.

14 Claims, 20 Drawing Sheets

(56) References Cited

U.S. PATENT DOCUMENTS

| | | | |
|---|---|---|---|
| 2008/0041282 | A1 | 2/2008 | Goschy |
| 2014/0102337 | A1 | 4/2014 | Ralph et al. |
| 2015/0208634 | A1 | 7/2015 | Box et al. |
| 2015/0320196 | A1 | 11/2015 | Polizzi |
| 2016/0037906 | A1 | 2/2016 | Knight |
| 2016/0113388 | A1 | 4/2016 | Distefano |
| 2016/0223002 | A1 | 8/2016 | Muller et al. |
| 2017/0042321 | A1 | 2/2017 | Clause et al. |

FIG. 17
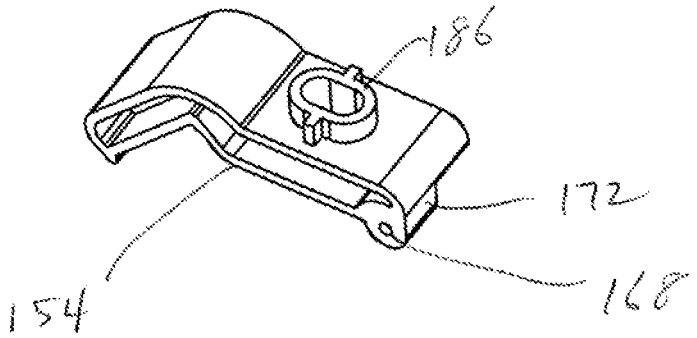
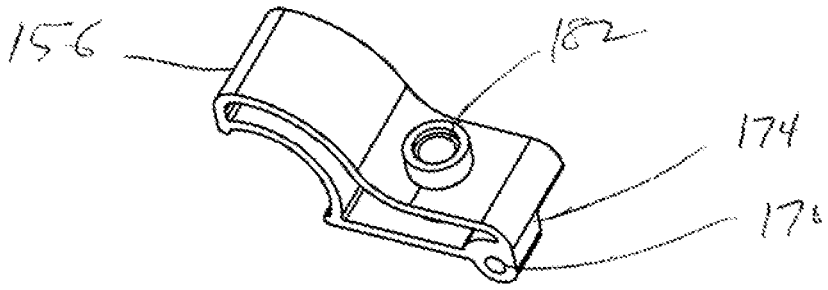
FIG. 18

SHELF ATTACHMENT FOR LOUNGE CHAIR

CROSS REFERENCE TO RELATED APPLICATIONS

This application is a continuation-in-part of U.S. Design Patent application Ser. No. 29/624,592 filed on Nov. 2, 2017, and is also a continuation-in-part of U.S. Design Patent application Ser. No. 29/621,902 filed on Oct. 12, 2017, and is also a continuation-in-part of U.S. Utility application patent application Ser. No. 15/596,744 filed on May 16, 2017, which in turn claims priority to U.S. Provisional Patent Application Ser. No. 62/337,565 filed on May 17, 2016. The entire disclosures of the above applications are hereby incorporated herein by reference.

BACKGROUND

This disclosure relates generally to chairs and more specifically to lightweight chairs commonly referred to as beach chairs or lawn chairs or beach/lounge chairs. The present disclosure provides an improved shelf, or legless table attachment for a lawn, pool or beach lounge chair. The table attachment of the present disclosure is capable of being easily adhered, rotated and removed from the arms of the chair or the frame of the chair by clamps which can mount onto the top, side, or bottom of the chair arms, rails or frame. The shelf attachment can also be folded for easy storage and transportation. The shelf can also be used for various applications, such as at the beach, a pool, a sporting event, at a campsite, etc. The shelf can be attached to a chair, or any frame, such as a table, a grill, etc.

The concept of lawn, or pool and beach lounge chairs is well known and further shelf-like attachments for these types of chairs, although limited, are known. However, many existing shelf attachments for folding lawn and zero gravity folding chairs are not effective for stationing (i.e. not foldable), reclining beach lounge chairs for several reasons.

First, existing shelf attachments are often positioned on the side of the person sitting in a foldable chair. The few shelf attachments that exist require the use of foldable legs of the chair to secure the unit to the chair. When the legs of the chair are extended open, the shelf is securely adhered to the chair; once you fold the chair legs back inward then the shelf disengages from the chair. This can be a cumbersome operation. Given that most, if not all, of stationary, reclining beach lounge chairs do not have foldable legs, these types of shelves do not apply and/or are not functional with these chairs.

Second, other types of shelf attachments are not foldable to be folded up neatly for storage or transportation. Thus, the shelf attachments that do not easily fold may severely limit the portability of the chair or shelf attachment. That said, some of the current side-connection shelves for foldable chairs, although small and removable, do not apply or are not effective for the standard resort-style, stationary, reclining beach lounge chair. These beach lounge chairs do not have foldable legs, therefore, these shelves would never be able to be adhered to these style of chairs.

Accordingly, it would be desirable to provide a shelf attachment for a chair including reclining beach lounge chairs, pool lounge chairs, and lawn chairs, including foldable lawn chairs, whereby the shelf attachment may be easily mounted to and removed from the chair and can be easily folded in half via a hinge for easy storage and transportation. Further, it would be desirable to provide a shelf attachment with a universal type clamp arrangement which can be used with a variety of chair frames, such as round or square or rectangular cross-sectional frames.

Still other aspects of the disclosure will become apparent upon reading and understanding the forgoing detailed description.

SUMMARY

In accordance with one embodiment of the disclosure, a shelf attachment for use with a lounge chair has: a first shelf half; a second shelf half hingedly connected to the first shelf half; and an elongated member extending through projections extending from the first shelf half and from the second shelf half to hingedly connect the first and second shelf halves; and a first clamp assembly secured to the first shelf half and a second clamp assembly secured to the second shelf assembly.

In accordance with another embodiment of the disclosure, the first shelf half and second shelf half are formed of thermoplastic material.

In accordance with another embodiment of the disclosure, the first and second shelf halves can be folded together.

In accordance with another embodiment of the disclosure, the shelf can be formed of one piece and be non-foldable.

In accordance with another embodiment of the disclosure, projections formed in the first shelf half interlock with projections formed in the second shelf half.

In accordance with another embodiment of the disclosure, the first shelf half has a cup holder opening for holding a cup holder formed of nylon mesh.

In accordance with another embodiment of the disclosure, storage pouches formed of nylon mesh can be secured to a side of the first shelf half and the second shelf half.

In accordance with another embodiment of the disclosure, the first and second clamp assembly each has a base having a first portion and a second portion and a substantially u-shaped opening formed between the first and second portions and a clamp pivot member is pivotally secured to the second portion of the base.

In accordance with another embodiment of the disclosure, the first clamp and second clamp assembly have foam rubber pads secured to the first portion and the clamp pivot member.

In accordance with another embodiment of the disclosure, the first clamp assembly and second clamp assembly each has an upper clamp and a lower clamp which are hingedly connected to each other, the upper clamp can have an upper angled wall and the lower clamp can have a curved wall.

In accordance with another embodiment of the disclosure, the first clamp assembly and second clamp assembly can be mounted to the first shelf half and the second shelf half in one of a first orientation and a second orientation 90 degrees or 180 degrees offset from the first orientation.

In a further embodiment, a first shelf half and a second shelf half are hingedly connected, and each of the first shelf half and the second shelf half have at least one aperture. The first shelf half and the second shelf half are configured to connect with a clamp having at least two protrusions, wherein the protrusions are disposed in the apertures on the first shelf half and the second shelf half.

In another embodiment, a first shelf half and a second shelf half are hingedly connected, and each of the first shelf half and the second shelf half have at least one aperture. The first shelf half and the second shelf are configured to connect with a clamp. The clamp has a first clamp wall, a base wall and a second clamp wall, and two hook-shaped protrusions disposed on the first clamp wall and two hook-shaped protrusions disposed on the base wall. The protrusions are disposed in the apertures on the first shelf half and the second shelf half.

In an additional embodiment, a first shelf half and a second shelf half are hingedly connected by two interlock pins, and each of the first shelf half and the second shelf half have two apertures. The first and second shelf are configured to connect with a clamp assembly. The clamp assembly has a first clamp wall, a base wall and a second clamp wall, and two hook-shaped protrusions disposed on the first clamp wall and two hook shaped protrusions disposed on the base wall. The second clamp wall has a threaded insert that receives a thumb screw, which is attached to a clamp plate with two projections. The hook-shaped protrusions are disposed in one apertures on the first shelf half and the second shelf half.

Still other aspects of the disclosure will become apparent upon a reading and understanding of the following detailed description.

DRAWINGS

The above, as well as other advantages of the present disclosure, will become readily apparent to those skilled in the art from the following detailed description, particularly when considered in the light of the drawings described hereafter.

FIG. 17 is a perspective view of an upper clamp of the clamp assembly of FIG. 15;

FIG. 18 is a perspective view of the lower clamp of the clamp assembly of FIG. 15;

DETAILED DESCRIPTION

Figure 1:
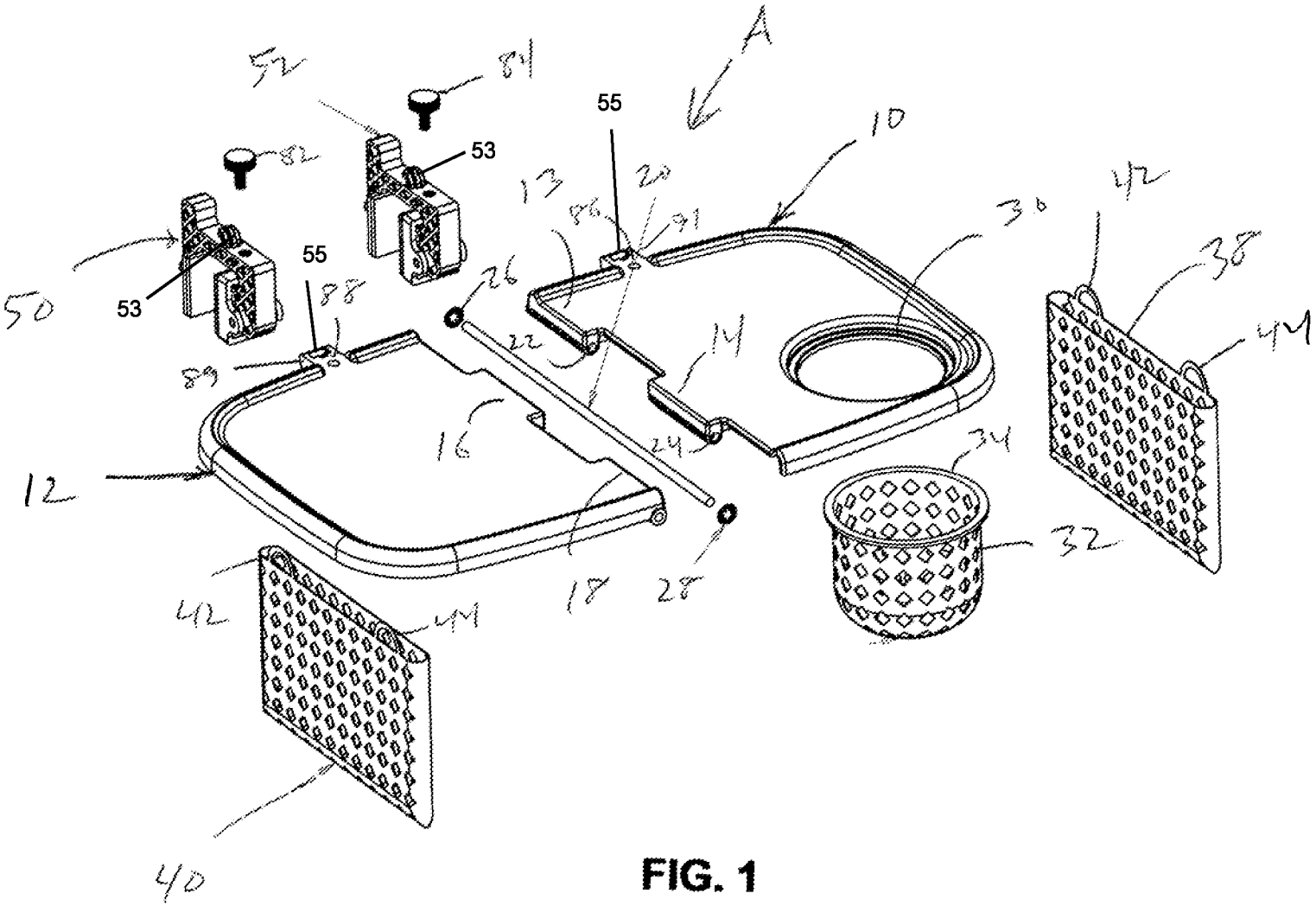
FIG. 1 is an exploded perspective view of the shelf assembly in accordance with a preferred embodiment of the disclosure.
Figure 2:
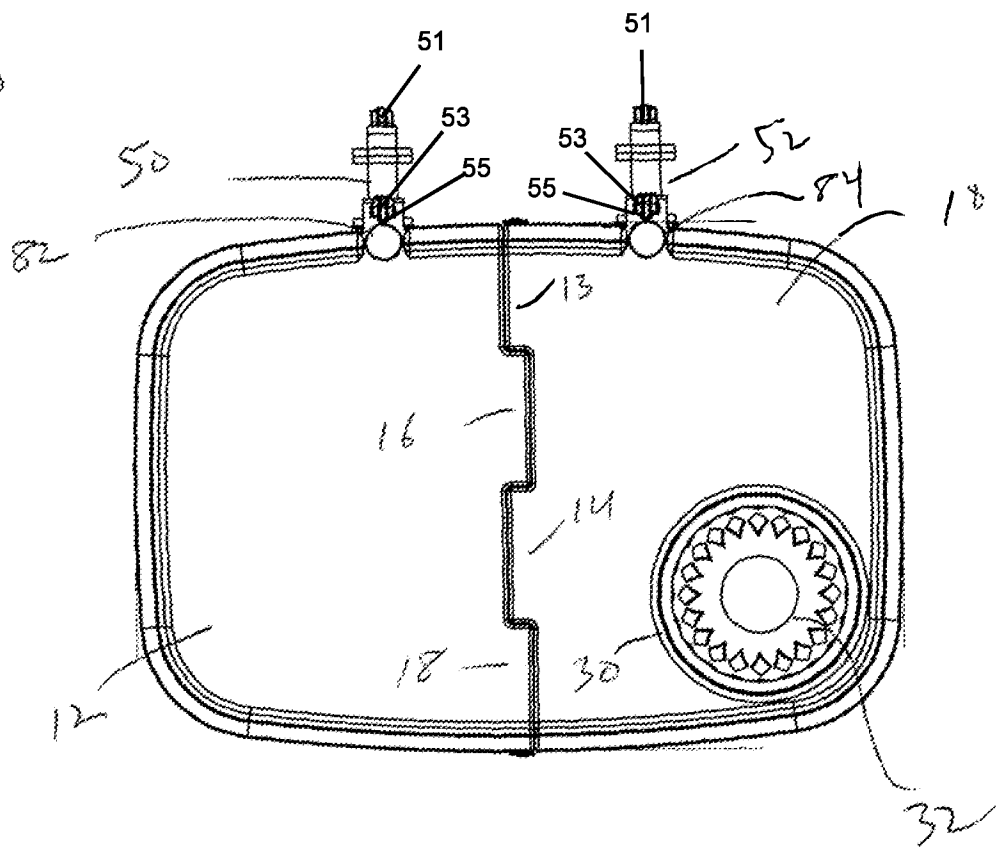
FIG. 2 is a top plan view of the shelf of FIG. 1.
Figure 3:
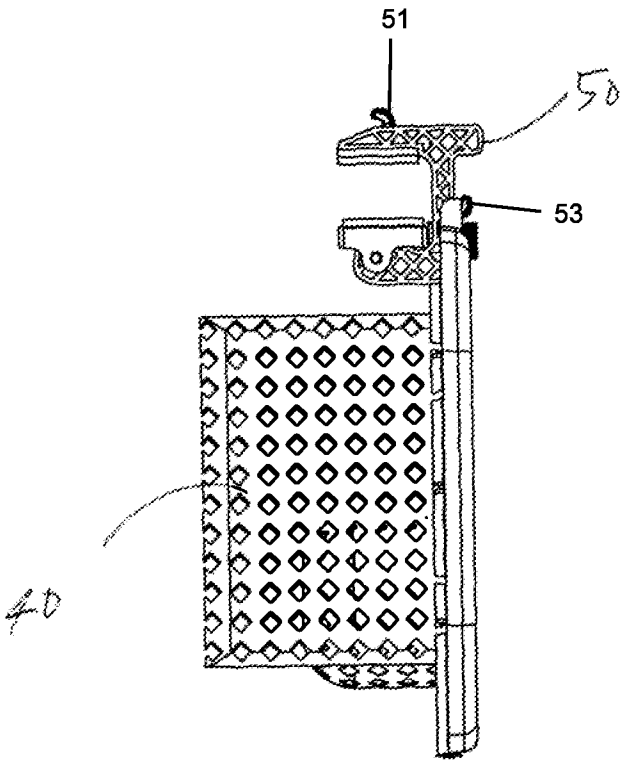
FIG. 3 is a side elevational view of the shelf of FIG. 1.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Like reference numerals will be used to refer to like or similar parts from Figure to Figure in the following description of the drawings.

Referring now to FIGS. 1-11, a shelf tray or attachment A is shown in accordance with a preferred embodiment of the disclosure.

The shelf tray has a first or left shelf half 10 and a second or right shelf half 12. The shelf can be made of any suitable material, but thermoplastic polymer such as acrylonitrile butadiene styrene (ABS) is preferred. An alternative shelf could be formed of one piece and be non-foldable.

First half 10 has one or more projections 13, 14 which interlock with mating projections 16, 18 on second half 12. A hinge pin 20 extends through openings 22, 24 formed in first and second halves to connect them together and form a hinge assembly so that the two halves 10, 12 can be rotated into a storage position or an in-use position in either an upwardly or downwardly direction. That is, one or both of the halves may be rotated with respect to the other. The hinge pin is preferably made of stainless steel. Retaining washers 26, 28 also made of stainless steel are secured to opposite ends for pin 20 to prevent the pin from sliding out of engagement with halves 10, 12 to facilitate locking the shelf halves together.

Shelf half 10 can also have a cup holder opening 30 for retaining a cup holder 32. Cup holder 32 is preferably made from a nylon mesh material and has an upper rim 34 for holding the cup holder in place within opening 30.

Figure 8:
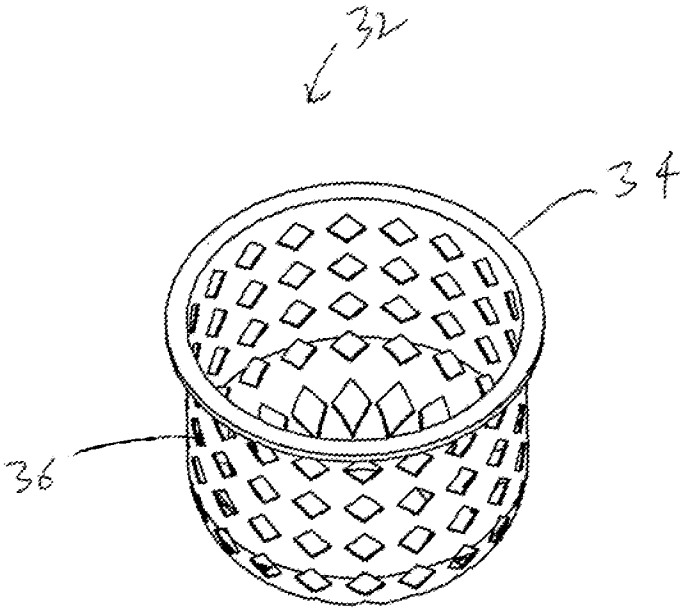
FIG. 8 is a perspective view of the cup holder of FIG. 6.
Figure 7:
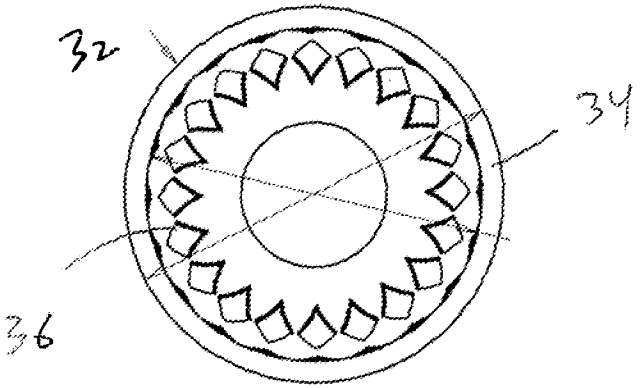
FIG. 7 is a top plan view of the cup holder of FIG. 6.
Figure 6:
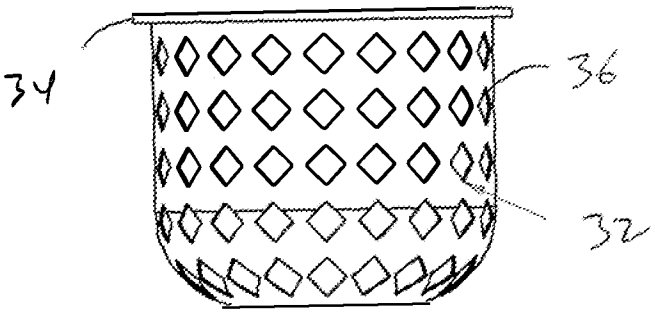
FIG. 6 is a side elevational view of a cup holder for the shelf of FIG. 1.

Referring now to FIGS. 6, 7 and 8, various views of the cup holder 32 and its mesh 36 are shown.

One or more storage pouches 38, 40, also formed of a nylon mesh, can be attached or secured to sides of the shelf halves via attachment loops 42, 44.

Figure 11:
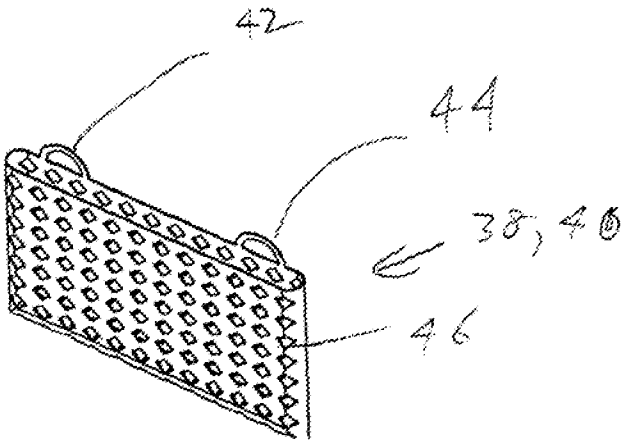
FIG. 11 is a perspective view of the storage pouch of FIG. 9.
Figure 10:
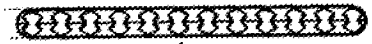
FIG. 10 is a top plan view of the pouch of FIG. 9.
Figure 9:
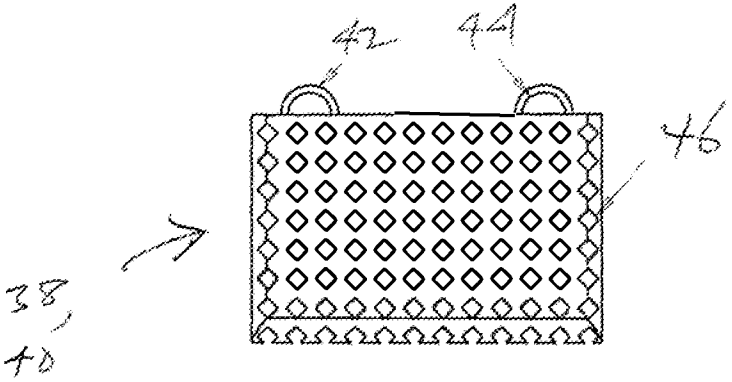
FIG. 9 is a side elevational view of a storage pouch for the shelf of FIG. 1.
Figure 12:
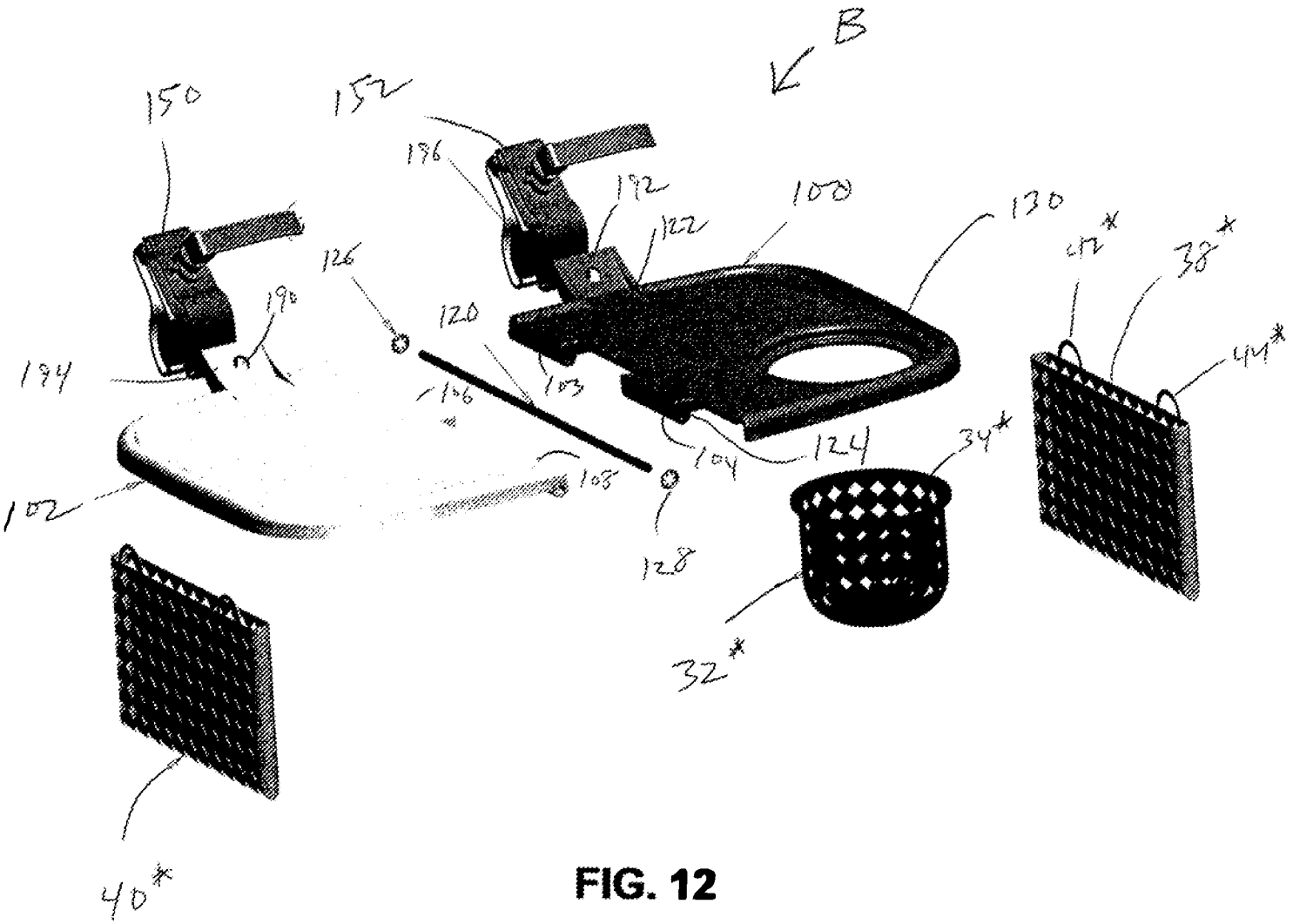
FIG. 12 is an exploded perspective view of a shelf assembly in accordance with another embodiment of the disclosure.
Figure 13:
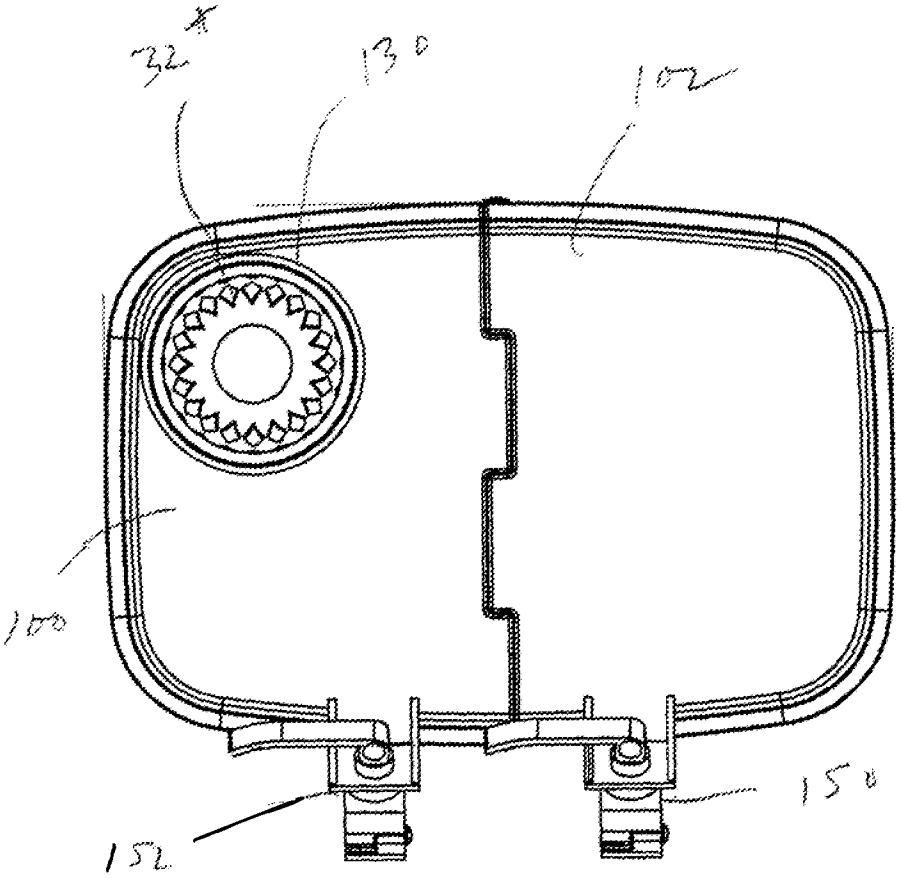
FIG. 13 is a top plan view of the shelf of FIG. 12.
Figure 14:
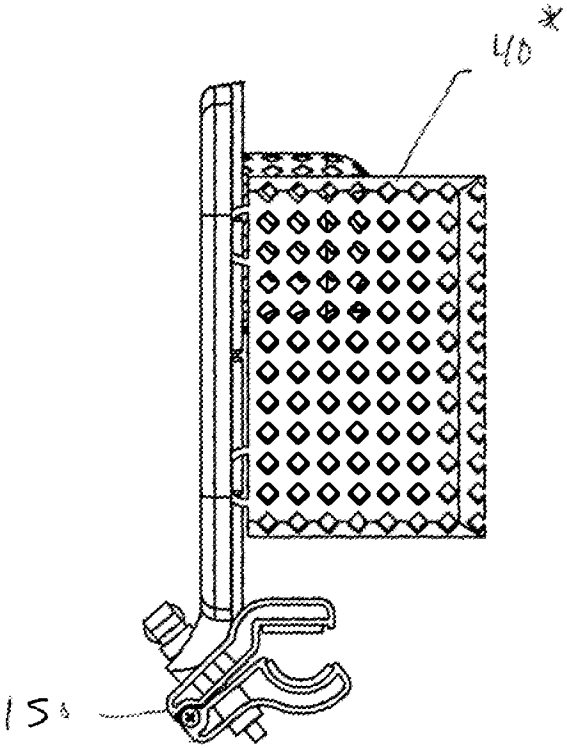
FIG. 14 is a side elevational view of the shelf of FIG. 12.

Referring to FIGS. 9, 10 and 11, various views of the storage pouches 38, 40 including mesh 46 are shown.

Figure 5:
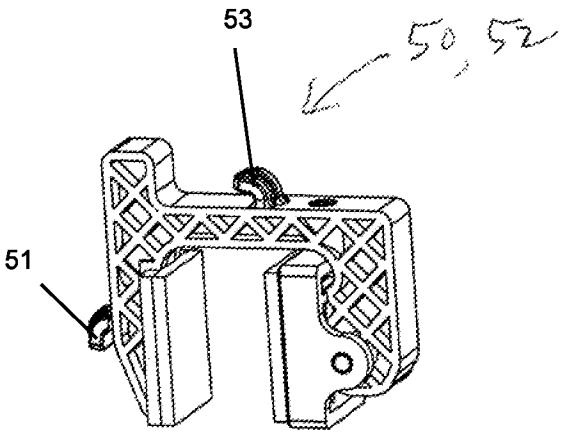
FIG. 5 is a perspective view of a assembled clamp assembly of FIG. 4.
Figure 4:
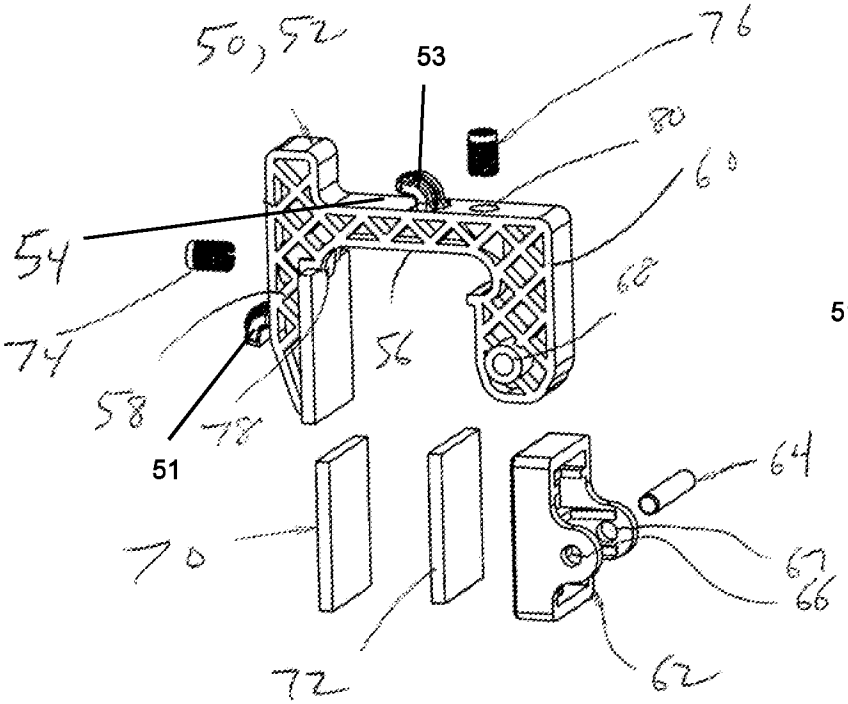
FIG. 4 is an exploded perspective view of a clamp assembly for the shelf in accordance with another aspect of the disclosure.

Referring back to FIG. 1, a pair of clamp assemblies 50, 52 in accordance with a preferred embodiment of the disclosure are shown. Referring now to FIGS. 4 and 5, details of the clamp assembly are shown. Clamp base 54, which is preferably made of thermoplastic polymer, such as ABS, has a substantially u-shaped opening 56 formed between walls 56, 60.

A clamp pivot 62, also preferably made of ABS, is pivotally secured to wall 60 via a dowel pin 64 inserted through opening 66 of wall 60 and opening 68 of pivot 62.

A pair of pads 70, 72, such as rubber or foam pads are secured to inner surfaces of walls 58, 60. Threaded inserts 74, 76 are inserted into openings 78, 80 of clamp base 54.

Thumb screws 82, 84 can be threaded into inserts 74, 76 and into openings 86, 88 in tabs 89, 91 extending from halves 10, 12 to retain the clamp assemblies to the shelf halves 10, 12. Each of the clamp assemblies 50, 52 also may have at least one protrusion 51, 53 that is configured to be removably received by an aperture 55 formed in one of the first shelf half 10 and the second shelf half 12. Advantageously, the clamp assemblies 50, 52 may have a first protrusion 51 and a second protrusion 53, disposed at different locations on the clamp assemblies 50, 52, allowing the clamp assemblies 50, 52 to connect with one of the first and second shelf halves 10, 12 in different orientations. For example, as shown in FIGS. 1-5 and 19-20, each of the clamp assemblies 50, 52 may have a first hook-shaped protrusion 51 affixed to one of the clamp walls 58, 60 and a second hook-shaped protrusion affixed to the base 54 of the clamp assembly 50, 52.

The clamps can be resiliently biased so they can flex outwardly when they are placed onto an arm rail or other rail of a chair and then biased inwardly to return toward their biased positions. The clamp assemblies can be installed on the shelves in the orientation shown in FIG. 19 ("orientation A") or rotated 90 degrees to the orientation shown in FIG. 20 ("orientation B"). The clamp assemblies lock onto a rail of a beach or lounge chair, such as an arm rail or a rear or back rail.

Referring now to FIGS. 12-18, a shelf tray or attachment B is shown in accordance with another embodiment of the disclosure. For items that are substantially the same as described for the embodiment of FIGS. 1-11, like referenced numerals are used with an asterisk.

The shelf tray has a first or left shelf half 100 and a second or right shelf half 102. The shelf can be made of any suitable material, but thermoplastic polymer such as acrylonitrile butadiene styrene (ABS) is preferred.

First half 100 has one or more projections 103, 104 which interlock with mating projections 106, 108 on second half 102. A hinge pin 120 extends through openings 122, 124 formed in first and second halves to connect them together and form a hinge assembly so that the two halves 100, 102 can be rotated into a storage position in either an upwardly or downwardly direction. That is, one or both of the halves may be rotated with respect to the other. The hinge pin is preferably made of stainless steel. Retaining washers 126, 128 also made of stainless steel are secured to opposite ends of pin 120 to prevent the pin from sliding out of engagement with halves 100, 102 and to facilitate locking the two shelf halves together.

Shelf half 100 can also have a cup holder opening 130 for retaining a cup holder 32*. Cup holder 32* is preferably made from a nylon mesh material and has an upper rim 34* for holding the cup holder in place within opening 130.

One or more storage pouches 38*, 40*, also formed of a nylon mesh, can be attached to sides of the shelf halves via attachment loops 42*, 44*.

Figure 16:
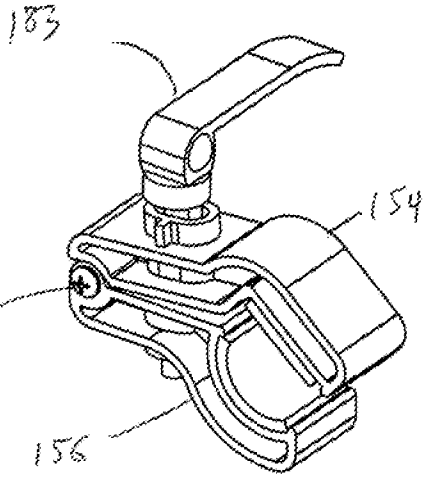
FIG. 16 is a perspective view of the clamp assembly of FIG. 15.
Figure 15:
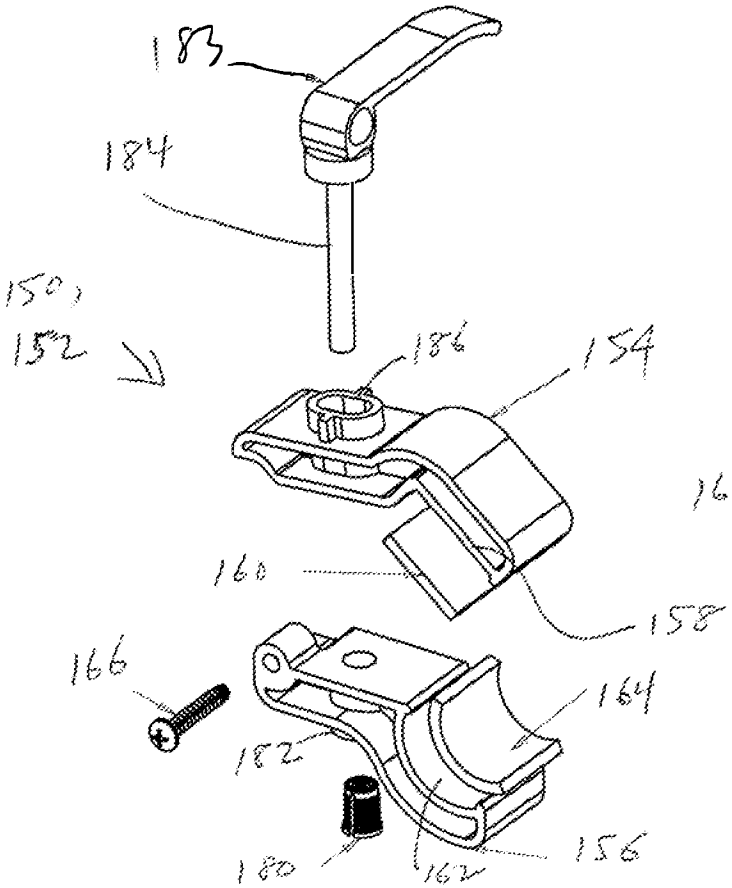
FIG. 15 is an exploded perspective view of a clamp assembly in accordance with another embodiment of the disclosure.
Figure 20:
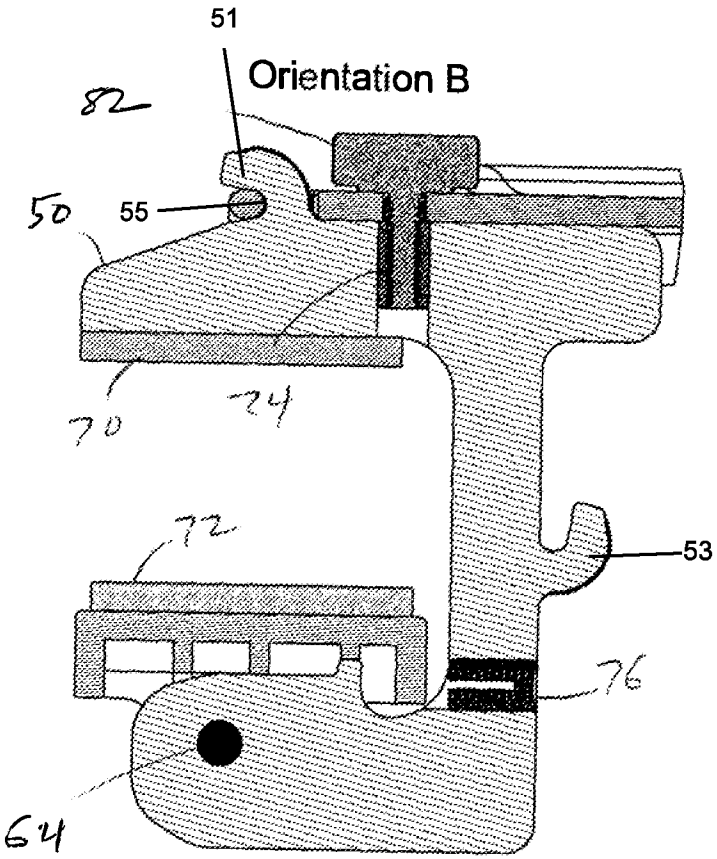
FIG. 20 is a cross-sectional view of the clamp assembly of FIG. 4 in a second orientation.
Figure 19:
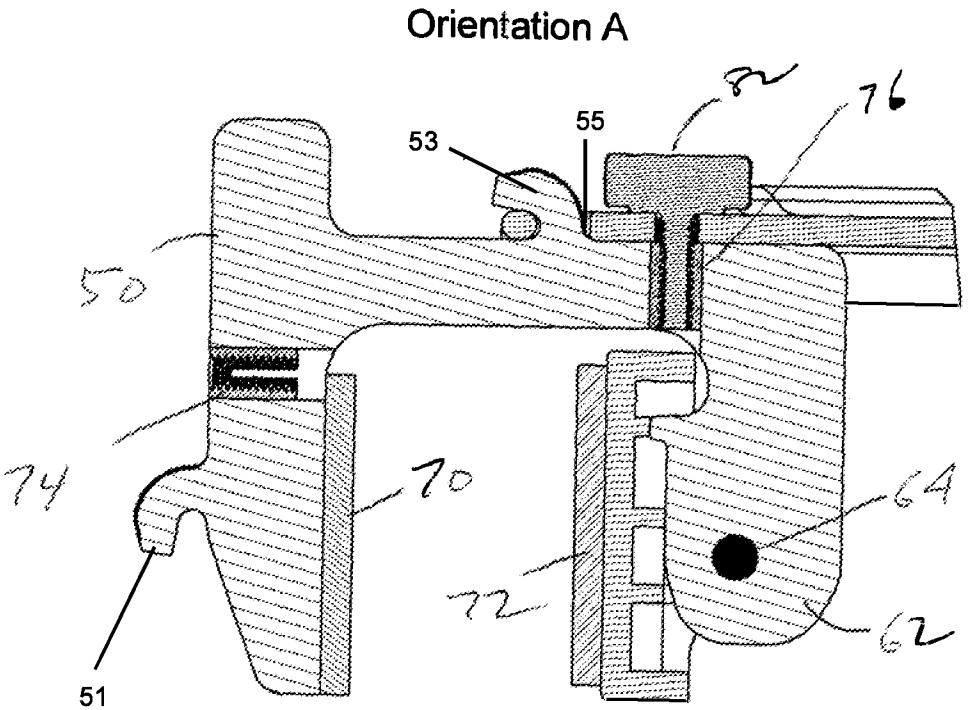
FIG. 19 is a cross-sectional view of the clamp assembly of FIG. 4 in a first orientation.

Referring now to FIGS. 15 and 16, a pair of clamp assemblies 150, 152 in accordance with another embodiment of the disclosure are shown. Each one of the clamp assemblies has an upper clamp 154 and a lower clamp 156. Clamps 154, 156 are preferably made of thermoplastic polymer, such as ABS. Upper clamp 154 has a substantially flat inner angled wall 158 to which a piece of foam rubber 160 is attached. Lower clamp 156 has a substantially c-shaped wall 162 to which a c-shaped piece of foam rubber 164 is attached. Upper and lower clamps 154, 156 are hingedly connected via a pin or screw 166 which extends through openings 168, 170 formed in projections 172, 174 of clamps 154, 156 (See FIGS. 17 and 18). That is, upper and lower clamps can be pivoted to create a larger or smaller opening in which to receive a chair rail.

A threaded insert 180 extends into and through an opening 182 formed in lower clamp 156. A handle 183 and pin 184 assembly is inserted into opening 186 in upper clamp 154 and through insert 180 to further secure the upper and lower clamps together.

Figure 21:
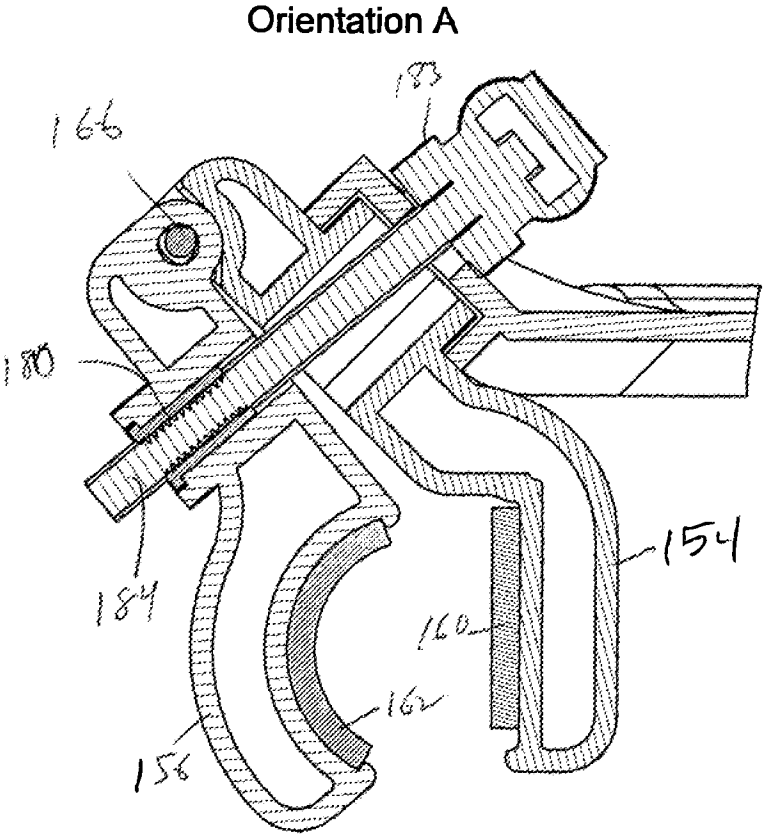
FIG. 21 is a cross-sectional view of the clamp assembly of FIG. 15 in a first orientation.
Figure 22:
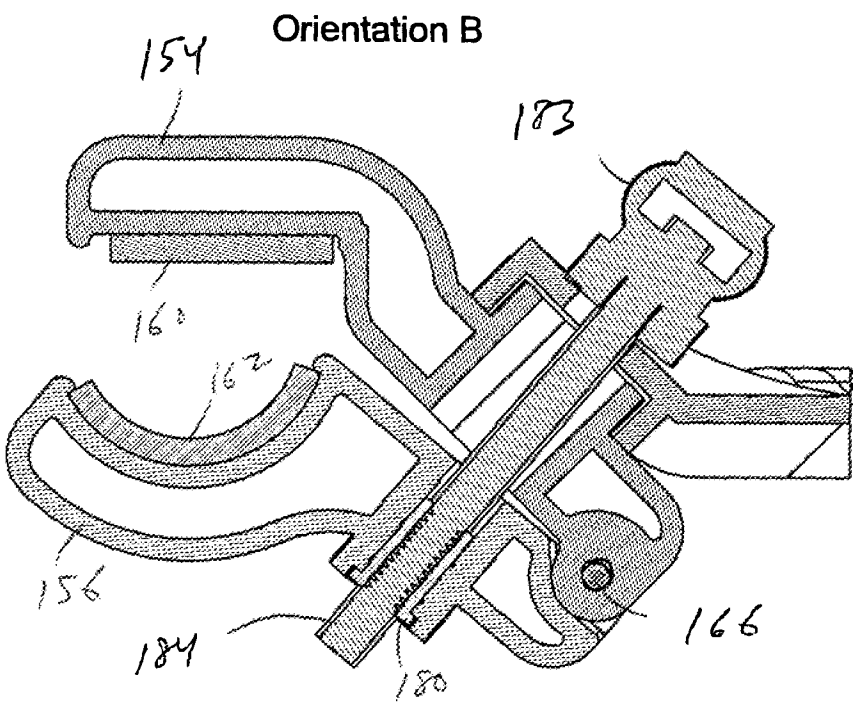
FIG. 22 is a cross-sectional view of the clamp assembly of FIG. 15 in a second orientation.
Figure 23:
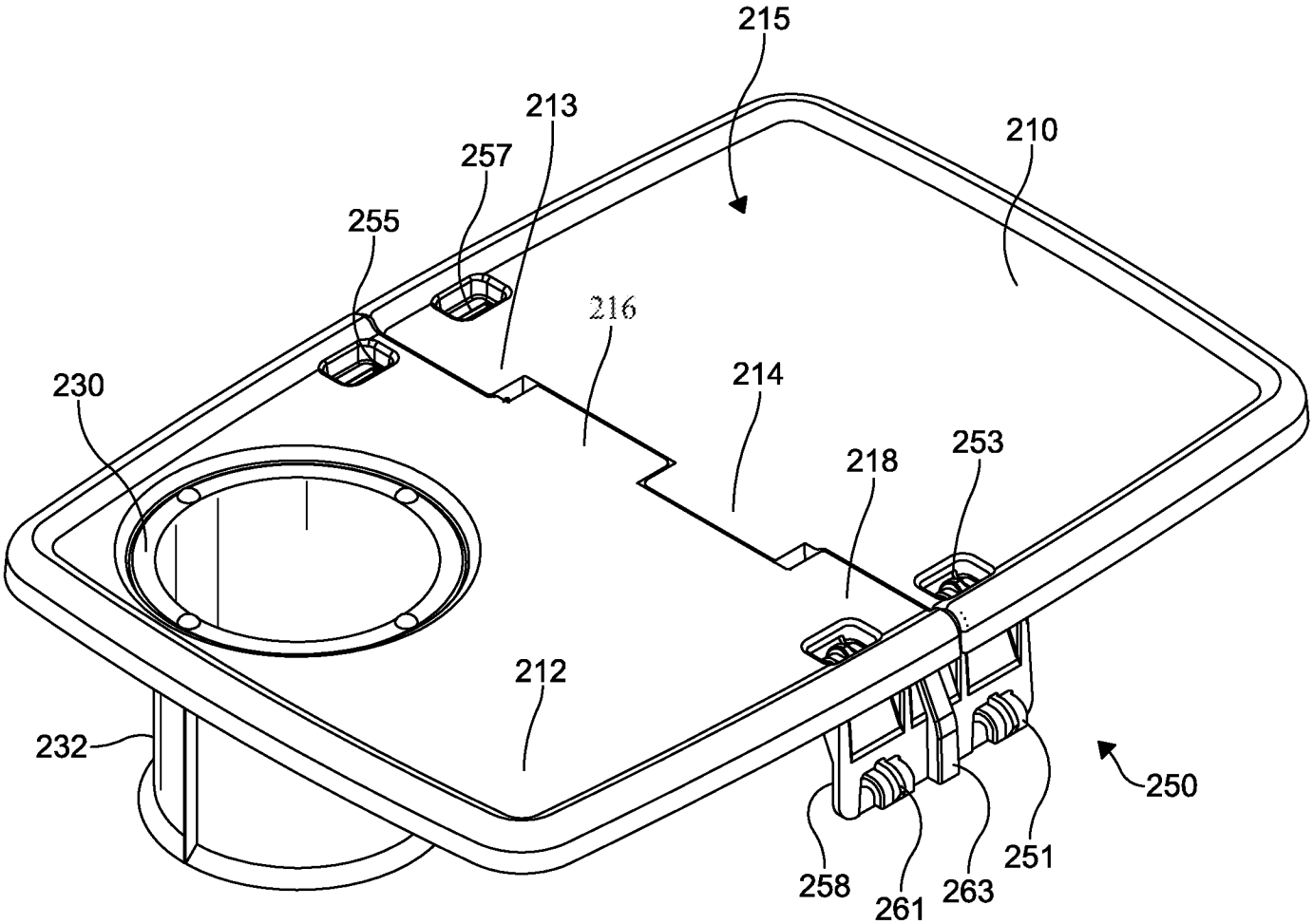
FIG. 23 is a top perspective view of the shelf assembly in accordance with a further embodiment of the disclosure.
Figure 24:
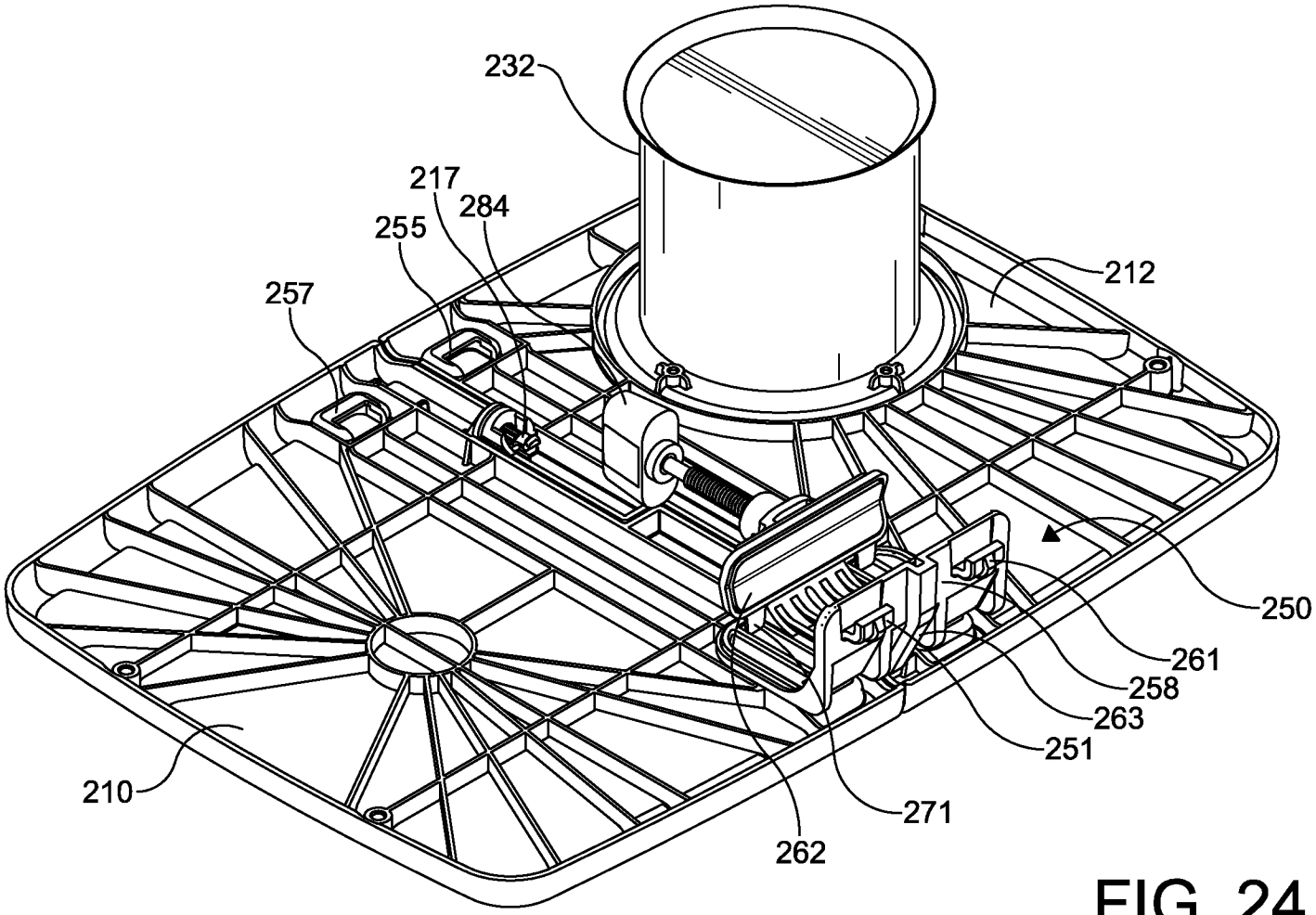
FIG. 24 is a bottom perspective view of the shelf assembly of FIG. 23.
Figure 25:
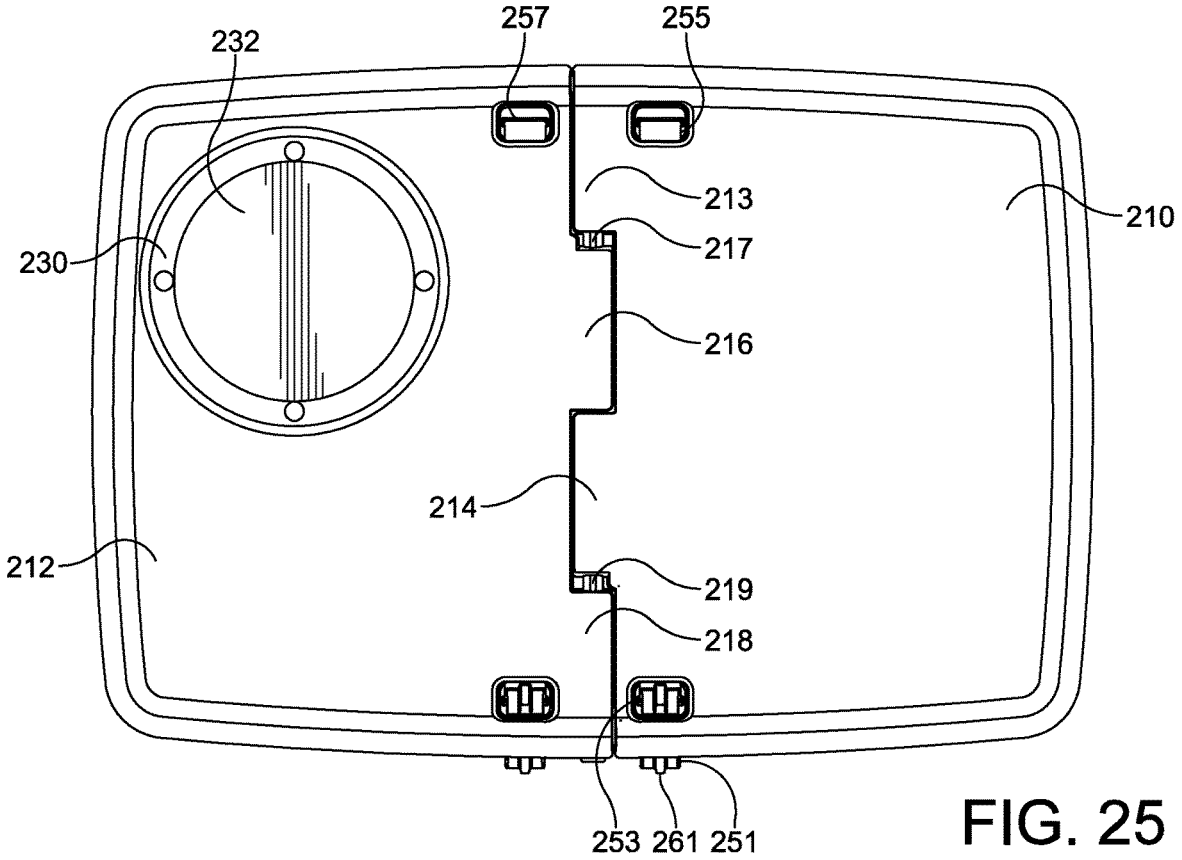
FIG. 25 is a top plan view of the shelf assembly of FIG. 23.
Figure 26:
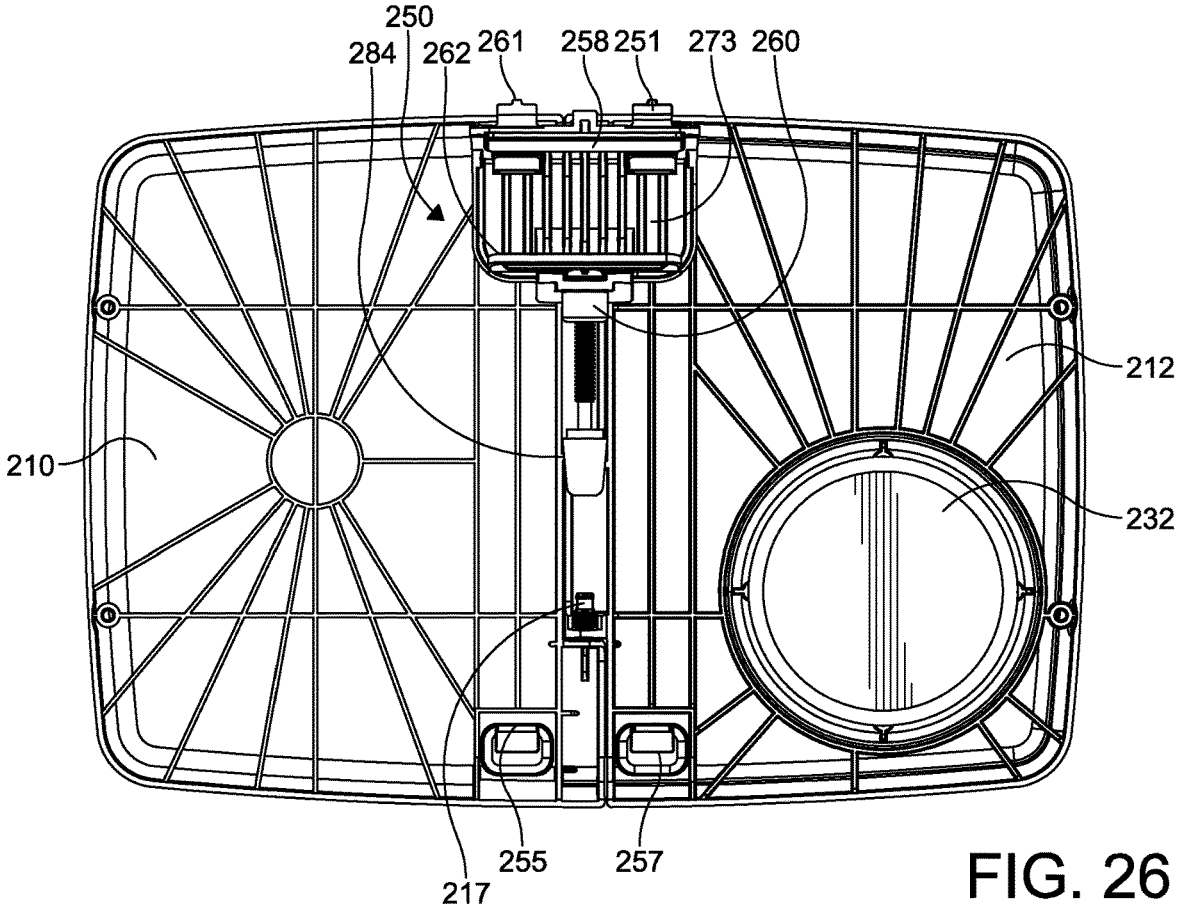
FIG. 26 is a bottom plan view of the shelf assembly of FIG. 23.
Figure 27:
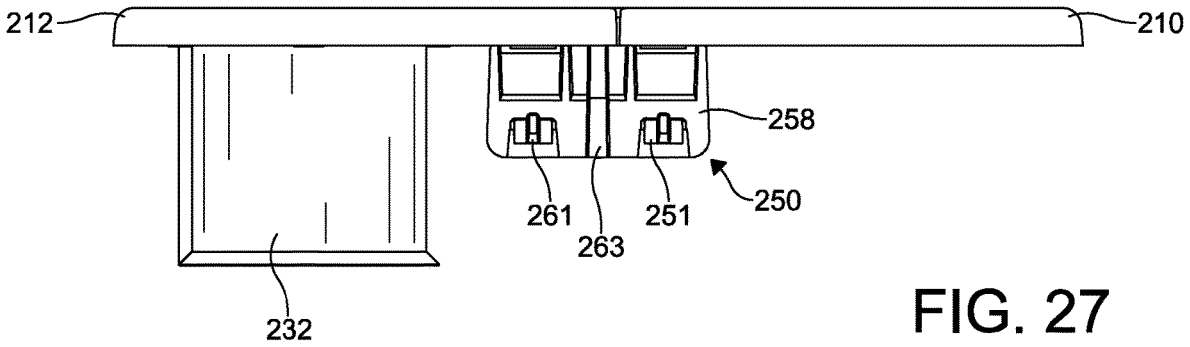
FIG. 27 is a front elevational view of the shelf assembly of FIG. 23.
Figure 28:
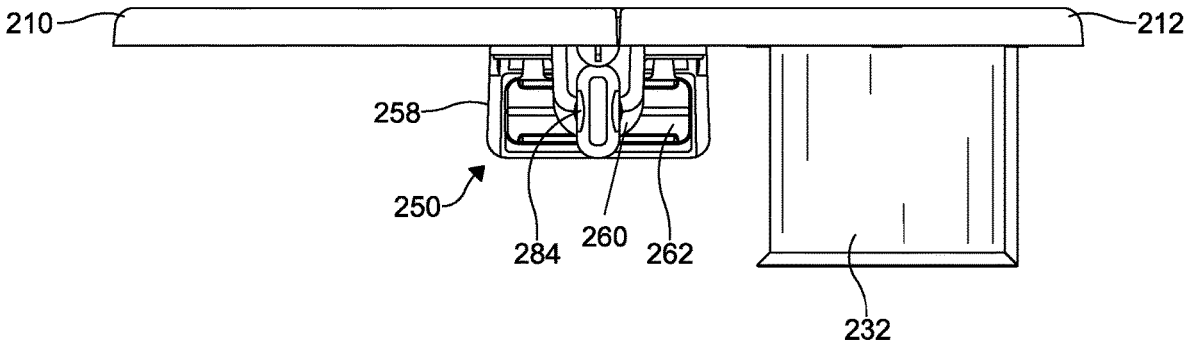
FIG. 28 is a rear elevational view of the shelf assembly of FIG. 23.
Figure 29:
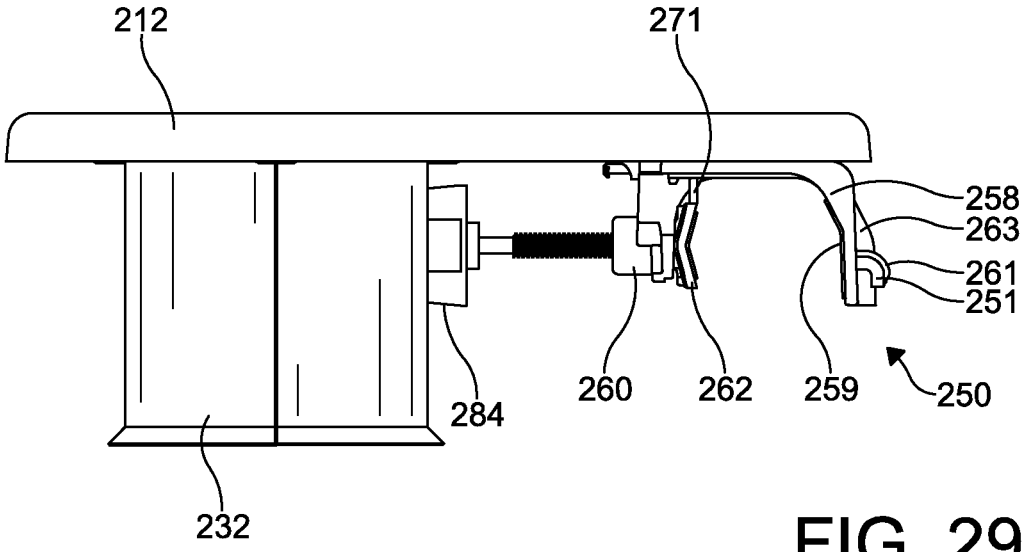
FIG. 29 is a is a left side elevational view of the shelf assembly of FIG. 23.
Figure 30:
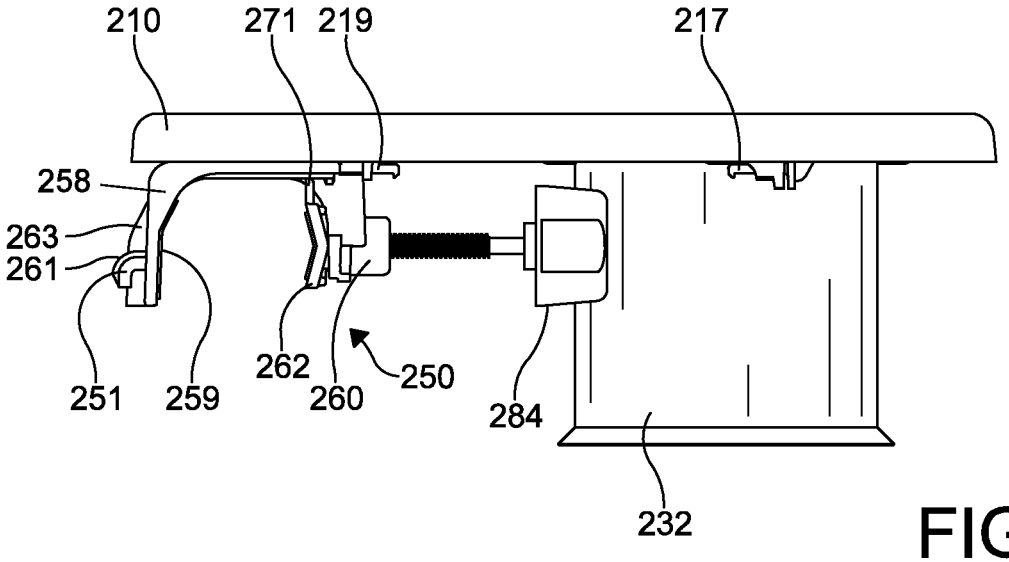
FIG. 30 is a is a left side elevational view of the shelf assembly of FIG. 23.
Figure 31:
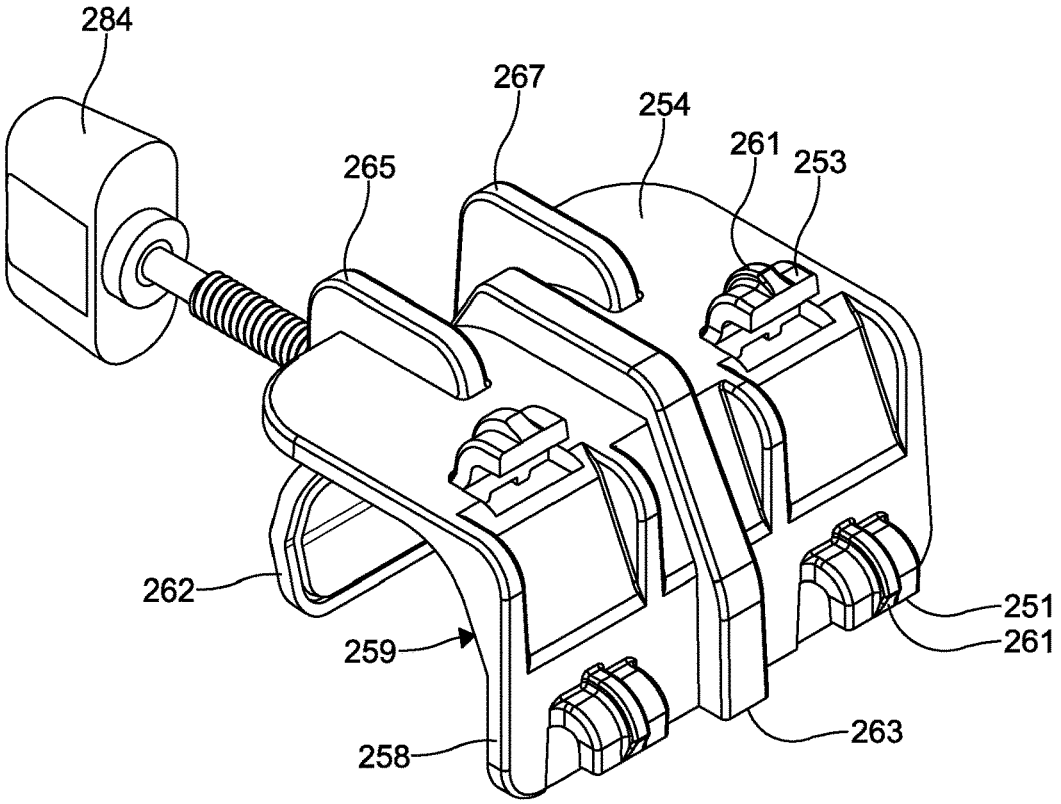
FIG. 31 is a top perspective view of the clamp assembly in accordance with a further embodiment shown in FIG. 23.
Figure 32:
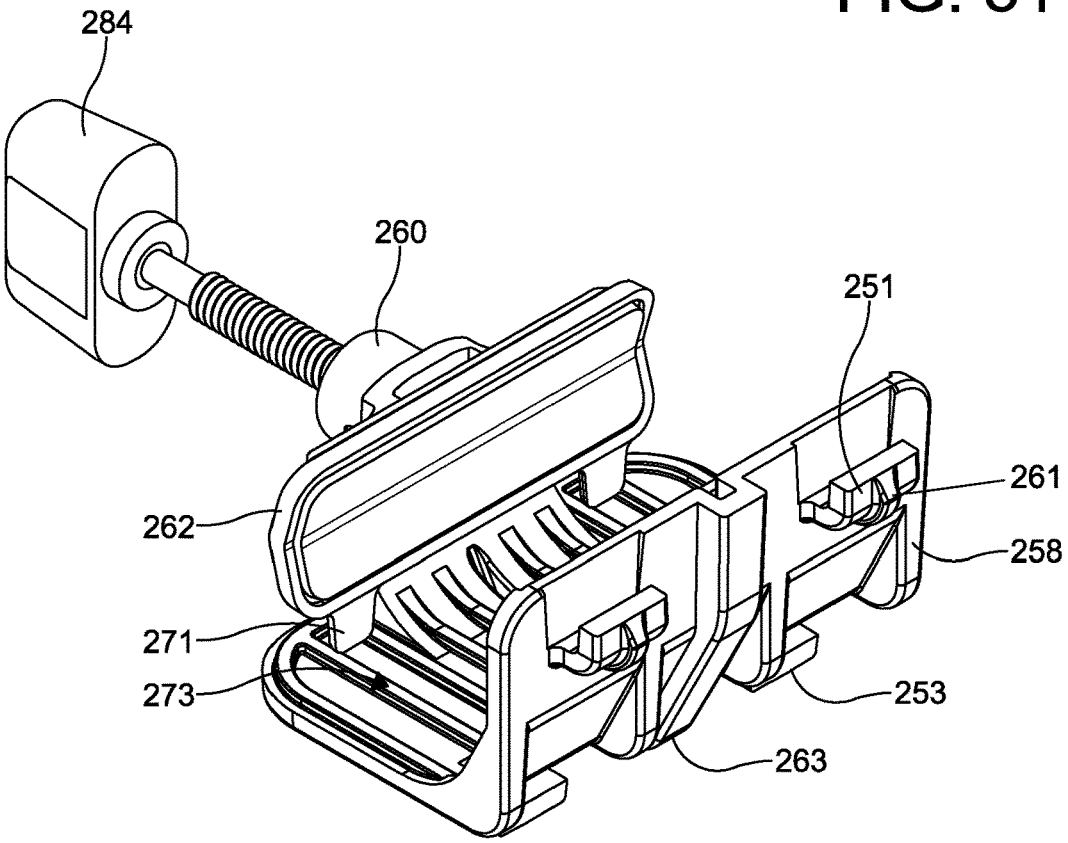
FIG. 32 is a bottom perspective view of the clamp assembly shown in FIG. 31.
Figure 33:
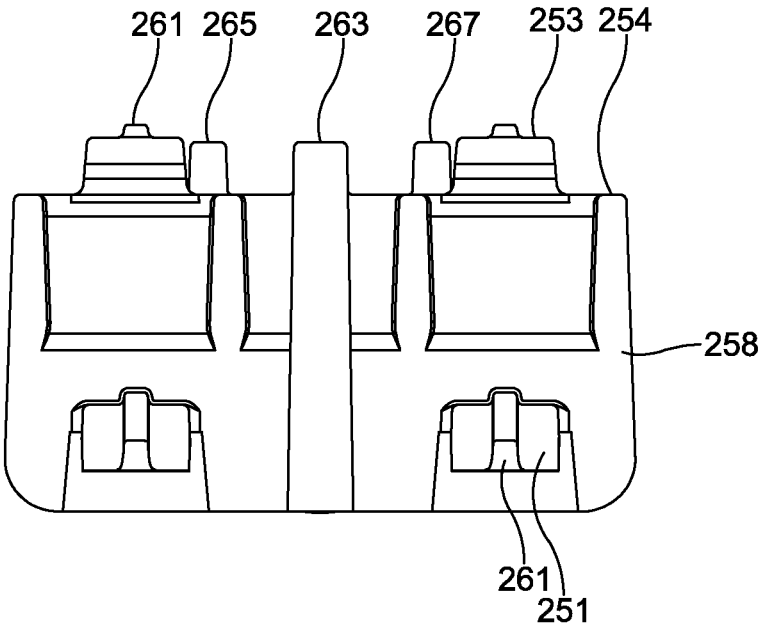
FIG. 33 is a front elevational view of the clamp assembly shown in FIG. 31.
Figure 34:
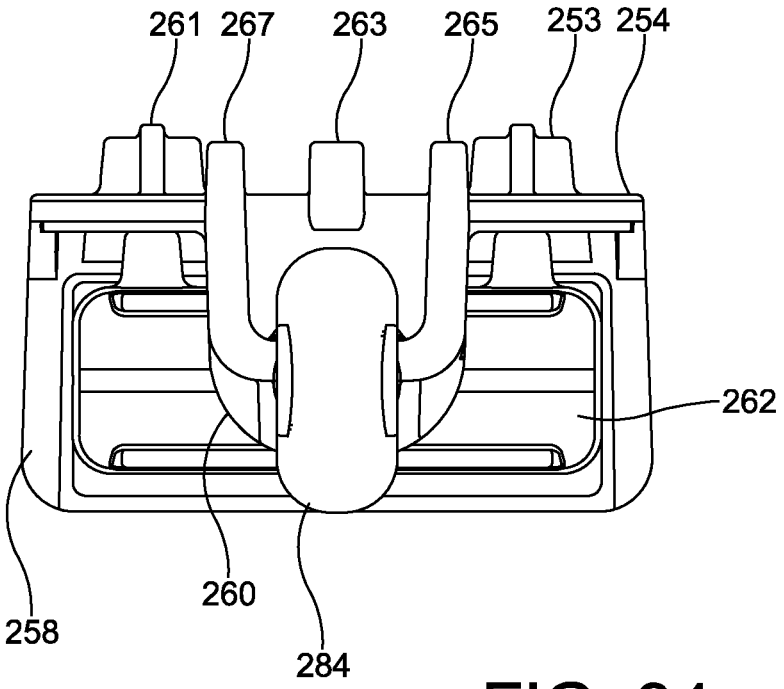
FIG. 34 is a rear elevational view of the clamp assembly shown in FIG. 31.
Figure 35:
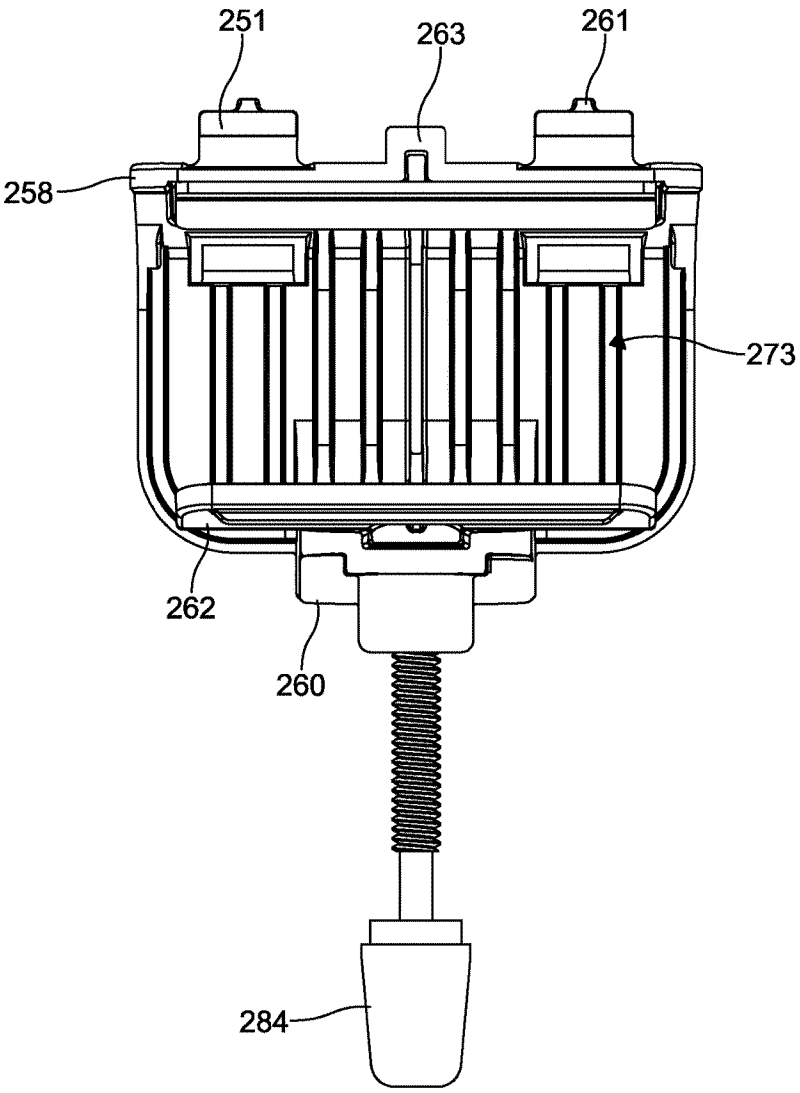
FIG. 35 is a bottom plan view of the clamp assembly shown in FIG. 31

The pin 184 is also inserted into openings 190, 192 formed in projections 194, 196 which extend from first and second shelf halves 100, 102. Projections 194, 196 are angled or curved upwardly with respect to the shelf halves 100, 102 to facilitate mounting the clamps at an angle to the shelf. As the pin 184 is threaded into threaded insert 180, the pin retains the upper and lower clamps to the shelf half. Handle 183 can be turned or rotated to tighten the pin within the threaded insert. The clamp assemblies can be mounted to the shelves as shown in FIG. 21 ("orientation A") or can be rotated 180° to be installed in another configuration as in FIG. 22 ("orientation B").

The clamp assemblies can be mounted or clamped onto the top of the frame or arm of a beach or lounge chair, or can be rotated and attached on the side of the arm or frame member. The clamp assembly and shelf can also be mounted onto the top of a back-rest frame of a chair.

Alternatively, the clamp assembly and shelf can be mounted on the frame at the front or leg rest portion of the chair.

The shelf can be used in various applications, including beach or pool lounge chairs, lawn chairs, tables or grills.

A clamp assembly can also be a universal clamp which can easily be mounted on a square or rectangular cross-sectional frame member or a round cross-sectional frame member or any other cross-sectional frame.

In a further embodiment, shown in FIGS. 23-37 the first shelf half 210 may be connected to the second shelf half 212 by two hinge interlock pins 217, 219. In certain embodiments, the first hinge interlock pin 217 extends from the projection 213 on the second shelf half 212, and is configured to connect with an aperture in projection 216 on the first shelf half 210. The second hinge interlock pin 219 extends from projection 218 on the first shelf half 210, and is configured to be connect with an aperture on projection 214 on the second shelf half 212. However, the first shelf half 210 and the second shelf half 212 may be foldably connected by a living hinge, flagged hinge, continuous hinge, bifold hinge, or any other hinge chosen by a skilled artisan.

Illustrated in FIGS. 31-37, the clamp assembly 250 may have a first clamp wall 258, a second clamp wall 260, and a base wall 254. The first clamp wall 258 may have an angled inner surface 259, while the second clamp wall 260 may have a threaded insert that is configured to receive the thumb screw 284. The thumb screw 284 is rotatably attached to a clamp plate 262. When the thumb screw 284 rotates, the clamp plate 262 is configured to move toward and away from the angled inner surface 259 of the first clamp wall 258. For example, the clamp plate 262 may move toward the first clamp wall 258 when the thumb screw 284 is turned clockwise, and away from the first clamp wall 258 when the thumb screw 284 is turned counter-clockwise. Consequentially, a user can tighten the clamp assembly 250 to various objects by turning the thumb screw 284, forcing the clamp plate 262 to abut the object. In certain embodiments, the clamp plate 262 can have two projections 271 that are configured to fit within a plurality of ridges 273 on the bottom of the base wall 254. The projections 271 prevent the clamp plate 262 from rotating as the thumb screw 284 is turned. The projections 271 ensure the clamp plate 262 remains parallel to the first clamp wall 258. Although two projections 271 are shown, any number of projections 271 may be chosen by a skilled artisan.

Figure 36:
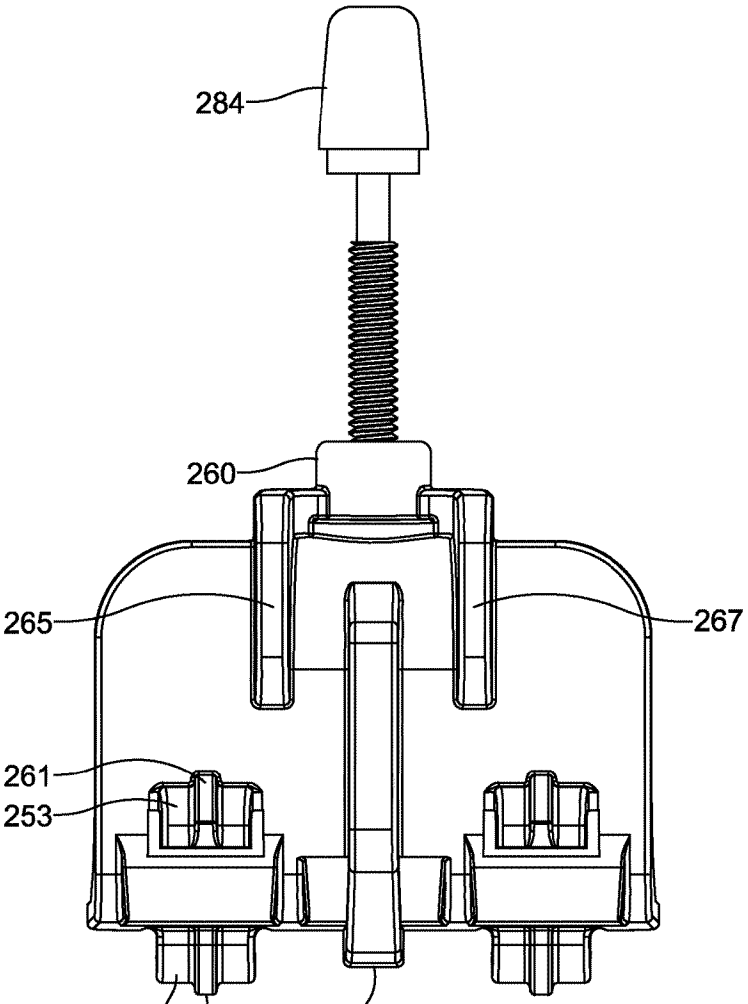
FIG. 36 is a top plan view of the clamp assembly shown in FIG. 31.
Figure 37:
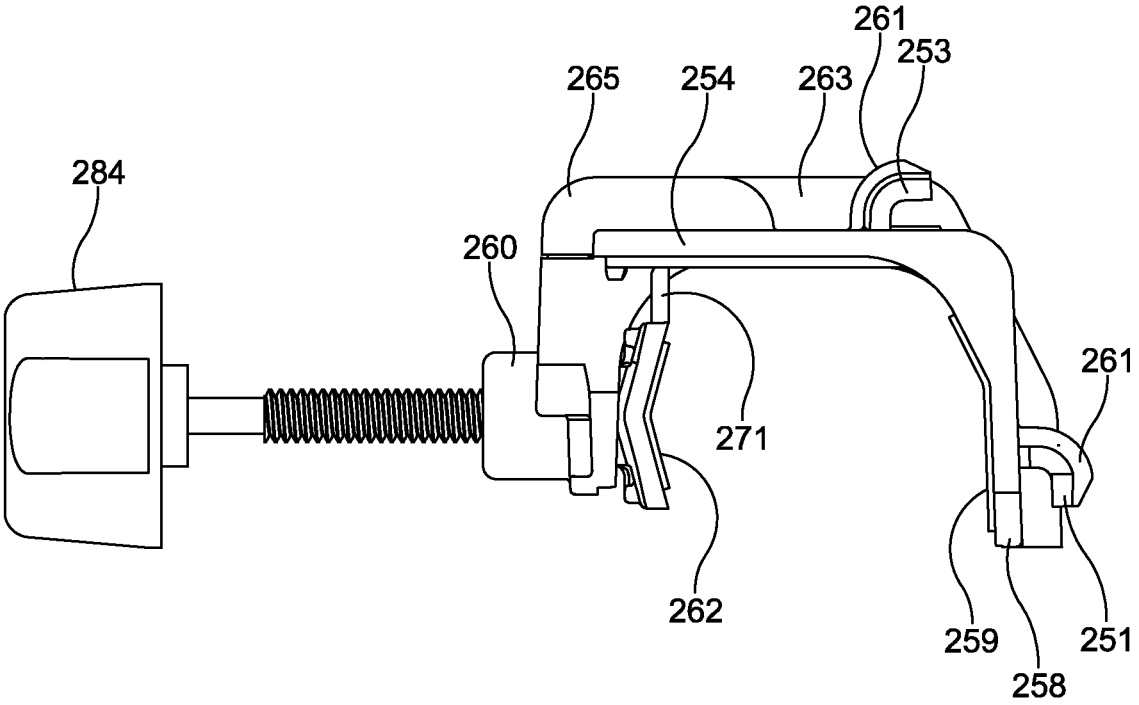
FIG. 37 is a side elevational view of the clamp assembly shown in FIG. 31.

With renewed reference to FIGS. 36-37 the clamp assembly 250 may have a first ridge 263, a second ridge 265 and a third ridge 267 connecting the base wall 254 to the second clamp wall 260. The ridges 263, 265, 267 add strength and rigidity to the clamp assembly 250 by securing the second clamp wall 260 to the base wall 254. The ridges 263, 265, 267 militate against the second clamp wall 260 warping as the thumb screw 284 is tightened. Although three ridges 263, 265, 267 are shown, any number of ridges can be chosen by a skilled artisan.

Illustrated in FIGS. 23-26, the first shelf half 210 and second shelf half 212 may each have two apertures 255, on opposing sides of the platform 215. For example, a pair of apertures 255 may be located on each of the first shelf half 210 and second shelf half 212 adjacent to projection 218 and, on the opposite side of the platform 215, adjacent to projection 213. The two apertures 255 are configured to connect with a first pair of protrusions 251 located on the first clamp wall 258 and a second pair of protrusions 253 located on the base wall 254. Each of the protrusions 251, 253 may be hook-shaped and have a central ridge 261 to add rigidity and stability to the protrusions 251, 253. Advantageously, the first pair of protrusions 251 and the second pair of protrusions 253 are attached to different locations on the clamp assembly 250. This allows the clamp assembly 250 to connect with the first shelf half 210 and the second shelf halves 212 in different orientations. For example, the clamp assembly 250 may be to be connected to the first shelf half 210 and the second shelf half 212 in a first orientation and a second orientation 90-degrees offset from the first orientation.

Moreover, as shown in FIGS. 23-26, the apertures 255 in the first shelf half 210 and the second shelf half 212 may have a ledge 257 adjacent to the aperture 255 and disposed apart from the platform 215. The ledge 257 is configured to abut the protrusion 251, 253, when disposed in the aperture 255. The ledge 257 prevents the protrusions 251, 253 from disengaging with the aperture 255. The protrusions 251, 253, apertures 255 and ledges 257 may be any shape as chosen by skilled artisan. Particularly, the aperture 255 and ledge 257 may be curved, or angled to match the curvature of the hook-shaped protrusions 251, 253.

For example, in operation, a user will place the clamp assembly 250 on a support structure, wherein the support structure is disposed between the angled inner surface 259 and the clamp plate 262. A user then tightens the thumb screw 284, forcing the clamp plate 262 to abut the support structure, and press the support structure onto the angled inner surface 259 of the first clamp wall 258. The force applied to the support structure by the thumb screw 284 secures the clamp assembly 250 to the support structure. After the clamp assembly 250 is secured to the support structure, the user opens the first shelf half 210 and the second shelf half 212, to create the platform 215. The user then connects the clamp assembly 250 to the first shelf half 210 and the second shelf half 212 by inserting the protrusions 251, 253 into an aperture 255 on each of the first shelf half 210 and the second shelf half 212. The platform 215 is now stably secured to the support structure and ready for use.

While certain representative embodiments and details have been shown for purposes of illustrating the invention, it will be apparent to those skilled in the art that various changes may be made without departing from the scope of the disclosure, which is further described in the following appended claims.

The invention claimed is:

1. A shelf attachment comprising:

a first shelf half and a second shelf half, wherein the first shelf half is hingedly connected to the second shelf half, each of the first shelf half and the second shelf having at least one aperture; and a clamp assembly having at least two protrusions disposed in at least one aperture on each of the first shelf half and the second shelf half, wherein the clamp assembly has a main body with a base wall, first clamp wall, and a second clamp wall, wherein the second clamp wall has a threaded insert that is configured to receive a thumb screw, wherein the thumb screw is attached to a clamp plate, and wherein the clamp plate has two projections configured to fit in a plurality of ridges on the base wall.

2. The shelf attachment of claim 1, wherein the first shelf half and the second shelf half are formed by thermoplastic material.

3. The shelf attachment of claim 1, wherein projections formed in the first shelf half interlock with projections formed in the second shelf half.

4. The shelf attachment of claim 1, wherein the first shelf half comprises a cup holder opening for holding a cup holder.

5. The shelf attachment of claim 1, wherein the first shelf half is connected to the second shelf half by two interlock pins.

6. The shelf attachment of claim 1, wherein the first clamp wall has an angled inner surface.

7. A shelf attachment comprising:

a first shelf half and a second shelf half, wherein the first shelf half is hingedly connected to the second shelf half, each of the first shelf half and the second shelf having at least one aperture; and a clamp assembly having at least two protrusions disposed in at least one aperture on each of the first shelf half and the second shelf half, wherein the clamp assembly has a main body with a base wall, first clamp wall, and a second clamp wall, and wherein the main body of the assembly has two protrusions attached to the first clamp wall and two protrusions attached to the base wall.

8. The shelf attachment of claim 7, wherein the protrusions are hook-shaped.

9. A shelf attachment comprising:

a first shelf half and a second shelf half, wherein the first shelf half is hingedly connected to the second shelf half, each of the first shelf half and the second shelf having at least one aperture; and a clamp assembly having at least two protrusions disposed in at least one aperture on each of the first shelf half and the second shelf half, wherein the clamp assembly can be mounted to each of the first shelf half and the second shelf half in one of a first orientation and a second orientation 90-degrees offset from the first orientation.

10. A shelf attachment, comprising:

a first shelf half and a second shelf half, wherein the first shelf half is hingedly connected to the second shelf half, and each of the first shelf half and the second shelf have at least one aperture;

a clamp assembly having a main body with a first clamp wall, a base wall and a second clamp wall, and two hook-shaped protrusions disposed on the first clamp wall and two hook-shaped protrusions disposed on the base wall; and the two hook-shaped protrusions disposed in at least one aperture on each of the first shelf half and the second shelf half.

11. The shelf attachment of claim 10, wherein the clamp assembly can be mounted to the first shelf half and the second shelf half in one of a first orientation, and a second orientation 90-degrees offset from the first orientation.

12. The shelf attachment of claim 10, wherein the second clamp wall has a threaded insert that is configured to receive a thumb screw.

13. The attachment of claim 12, wherein the thumb screw is attached to a clamp plate.

14. The shelf attachment of claim 13, wherein the clamp plate has two projections that fit within a plurality of ridges on the base wall.

* * * * *